US012760950B2

(12) United States Patent
Song et al.

(10) Patent No.: US 12,760,950 B2
(45) Date of Patent: Oct. 13, 2026

(54) REFRIGERATOR AND CONTROL METHOD THEREOF

(71) Applicant: LG ELECTRONICS INC., Seoul (KR)

(72) Inventors: Youngseung Song, Seoul (KR); Kyong Bae Park, Seoul (KR); Min Hyuk Park, Seoul (KR); Yun Su Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 569 days.

(21) Appl. No.: 18/266,235

(22) PCT Filed: Nov. 12, 2021

(86) PCT No.: PCT/KR2021/016575
§ 371 (c)(1),
(2) Date: Jan. 16, 2024

(87) PCT Pub. No.: WO2022/131563
PCT Pub. Date: Jun. 23, 2022

(65) Prior Publication Data

US 2025/0377144 A1 Dec. 11, 2025

(30) Foreign Application Priority Data

Dec. 14, 2020 (KR) ..... 10-2020-0174462

(51) Int. Cl.
*F25B 49/02* (2006.01)

(52) U.S. Cl.
CPC .... *F25B 49/022* (2013.01); *F25B 2700/2104* (2013.01)

(58) Field of Classification Search
CPC ..... F25B 49/022; F25B 2600/0251; F25B 2700/2104; F25D 29/00; F25D 11/02; F25D 2700/121
See application file for complete search history.

(56) References Cited

U.S. PATENT DOCUMENTS

| | | | | |
|---|---|---|---|---|
| 11,226,145 | B2 * | 1/2022 | Seong | F25D 29/00 |
| 2012/0047932 | A1 * | 3/2012 | Yanagida | F25D 29/00 62/228.1 |
| 2019/0011158 | A1 * | 1/2019 | Sul | F25B 49/02 |
| 2020/0088462 | A1 * | 3/2020 | Ahn | F25D 17/067 |
| 2021/0302092 | A1 * | 9/2021 | Ahn | F25B 5/02 |

FOREIGN PATENT DOCUMENTS

| | | | |
|---|---|---|---|
| KR | 10-2014-0019594 | A | 2/2014 |
| KR | 10-1517248 | B1 | 4/2015 |

* cited by examiner

*Primary Examiner* — Lionel Nouketcha
(74) *Attorney, Agent, or Firm* — Bryan Cave Leighton Paisner LLP

(57) ABSTRACT

The present invention is configured such that, after operation-start conditions for load-responsive operation have been met and load-responsive operation has been implemented, if the in-compartment temperature inside a storage chamber, when a door is opened, satisfies operation-termination conditions or a change in the in-compartment temperature will satisfy operation-termination conditions, the load-responsive operation is terminated. Thus, excessive power consumption during load-responsive operation can be prevented, and thus it is possible to improve the power consumption resulting therefrom.

17 Claims, 11 Drawing Sheets

【Figure 1】
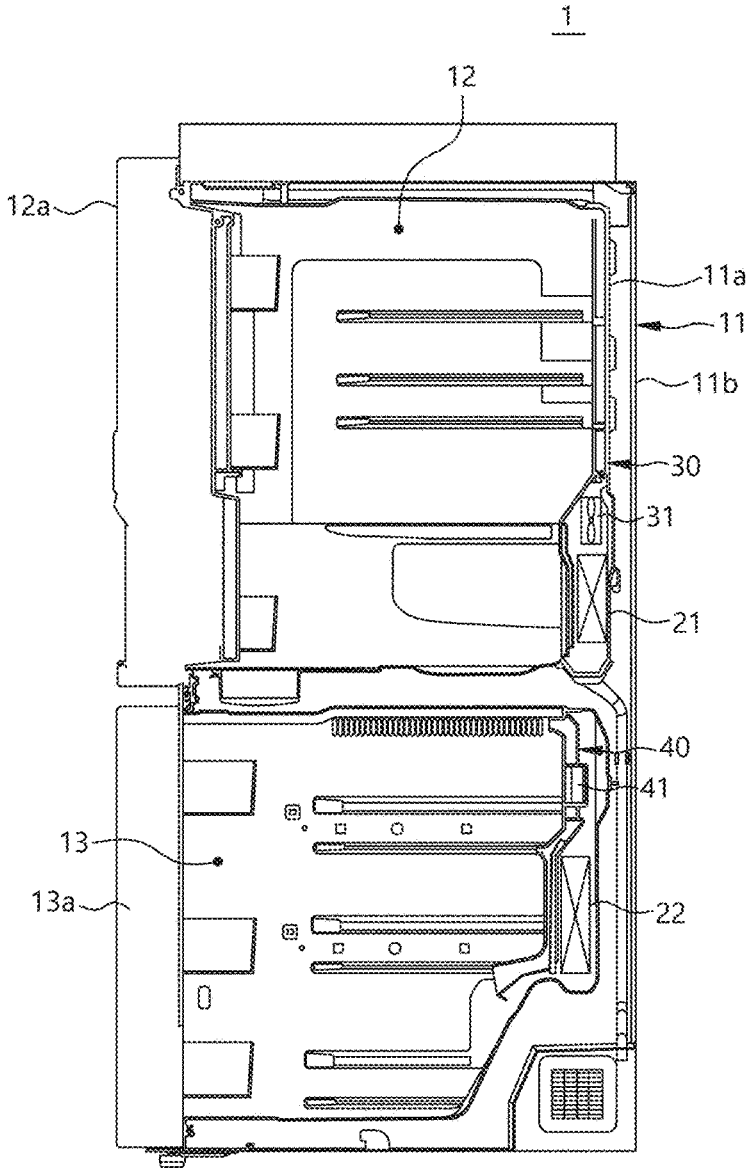

【Figure 2】
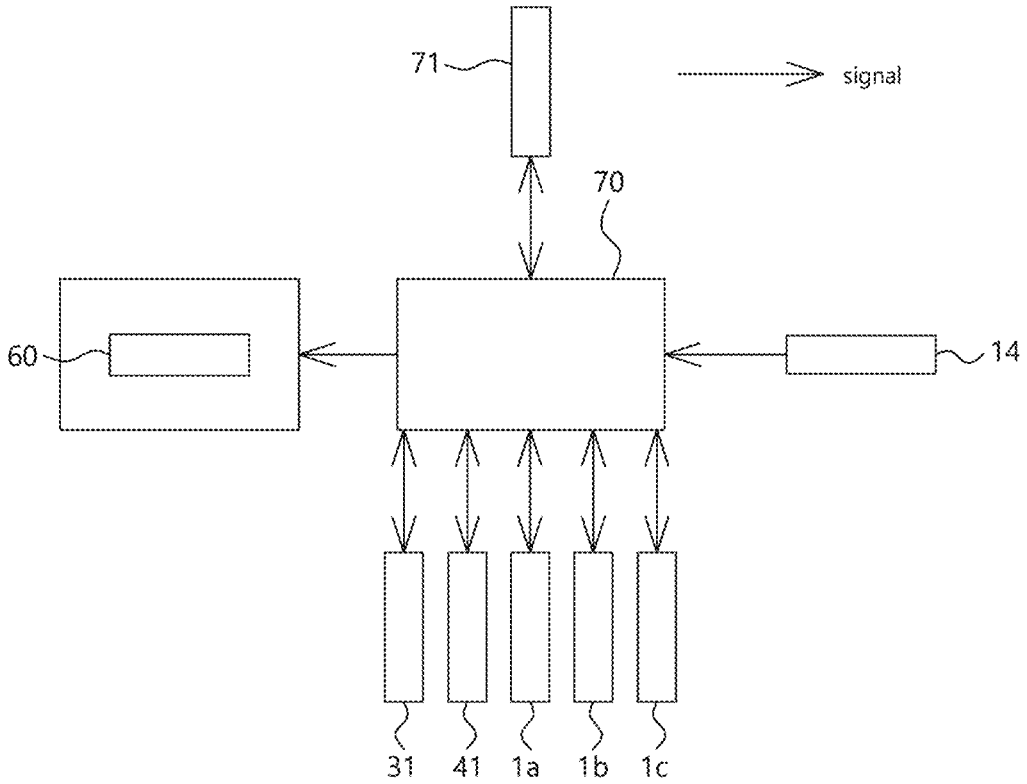
【Figure 3】
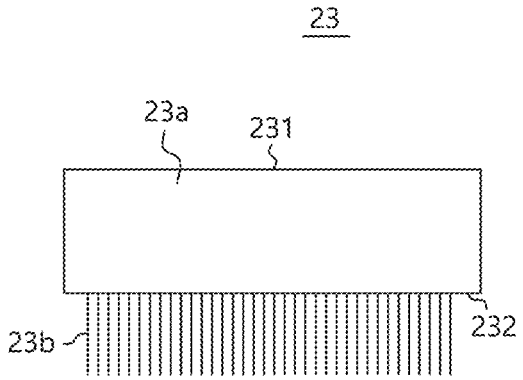

【Figure 4】
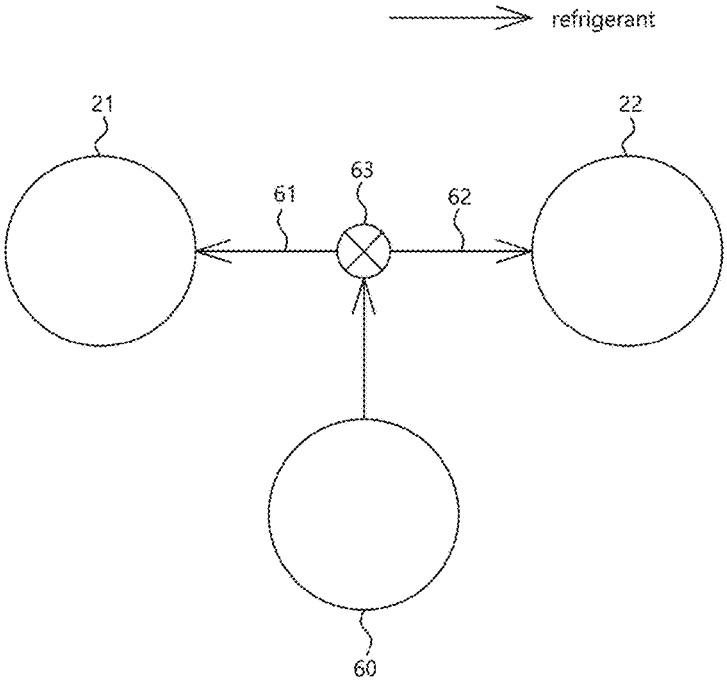
【Figure 5】
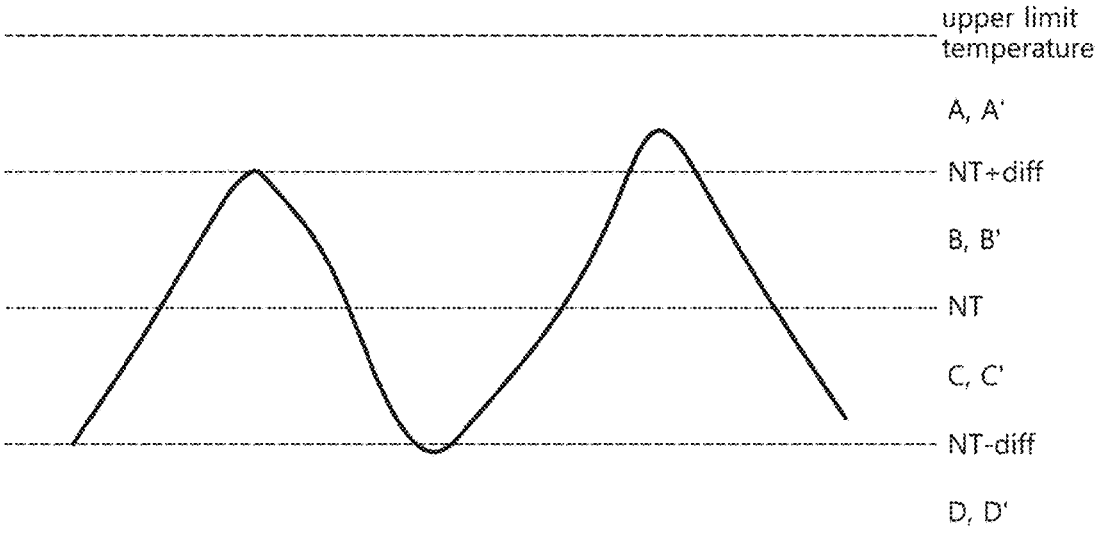

【Figure 6】

| Cooling power | A' | B' | C' | D' |
|---|---|---|---|---|
| A | 100 | 80 | 60 | 40 |
| B | 90 | 70 | 50 | 30 |
| C | 80 | 60 | 40 | 20 |
| D | 70 | 50 | 30 | 0 |

【Figure 7】

| Cooling power required | 1st storage compartment | 2nd storage compartment |
|---|---|---|
| A(A') -> B(B') | 70 | 30 |
| B(B') -> C(C') | 50 | 20 |
| C(C') -> D(D') | 30 | 10 |

【Figure 8】

| time required | 1st storage compartment | 2nd storage compartment |
|---|---|---|
| B(B') -> C(C') | 6min | 2.3min |
| C(C') -> D(D') | 6.8min | 2.5min |

【Figure 9】
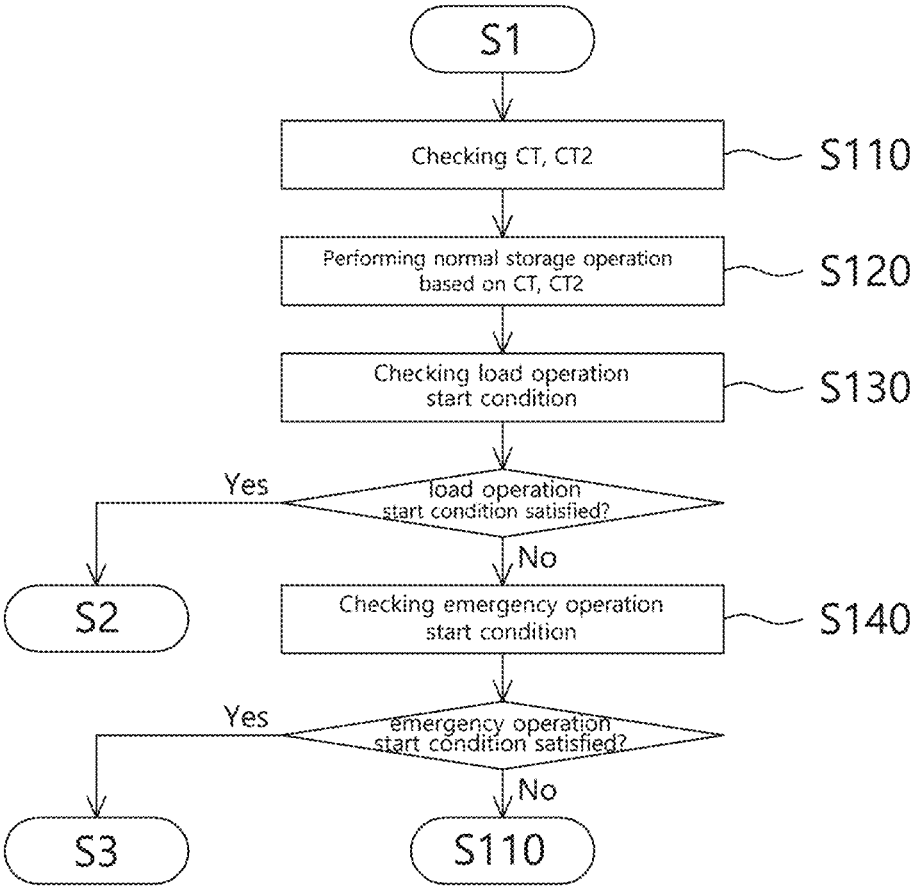

【Figure 10】
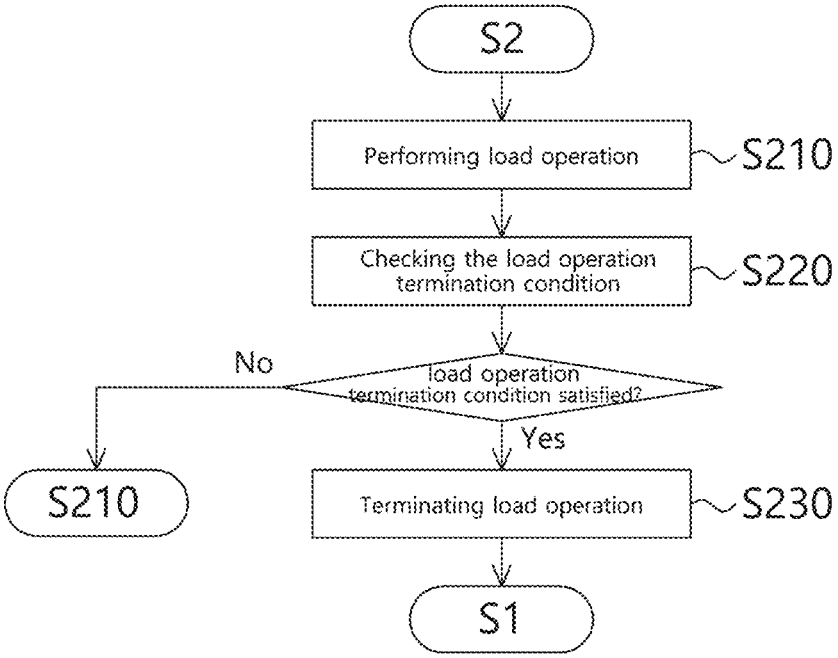

【Figure 11】
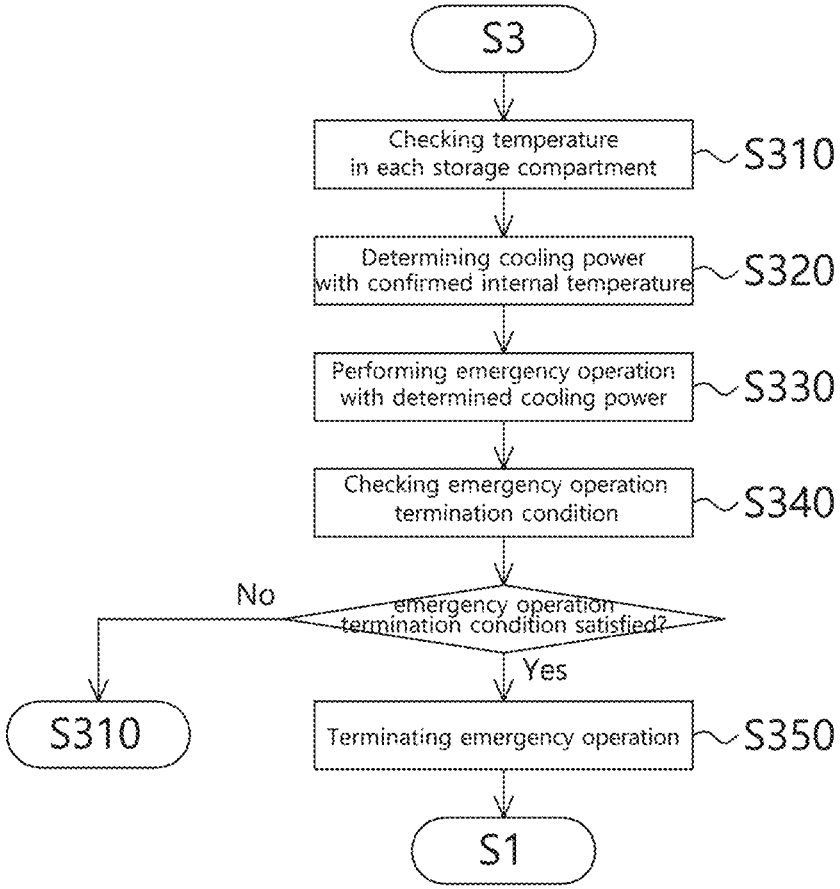

【Figure 12】
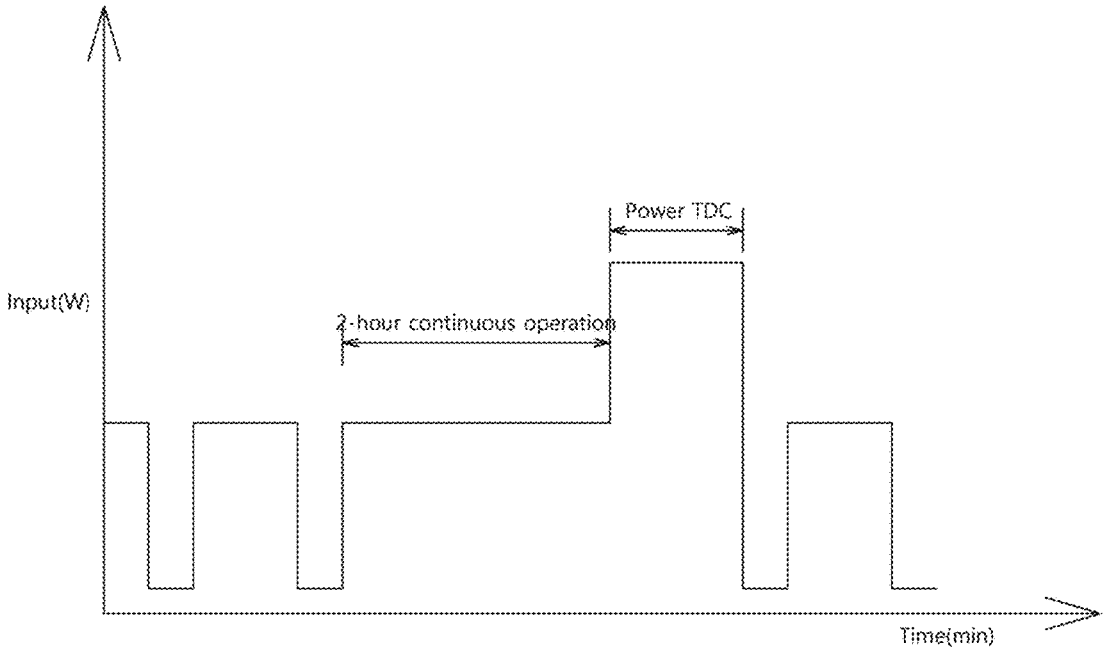
【Figure 13】
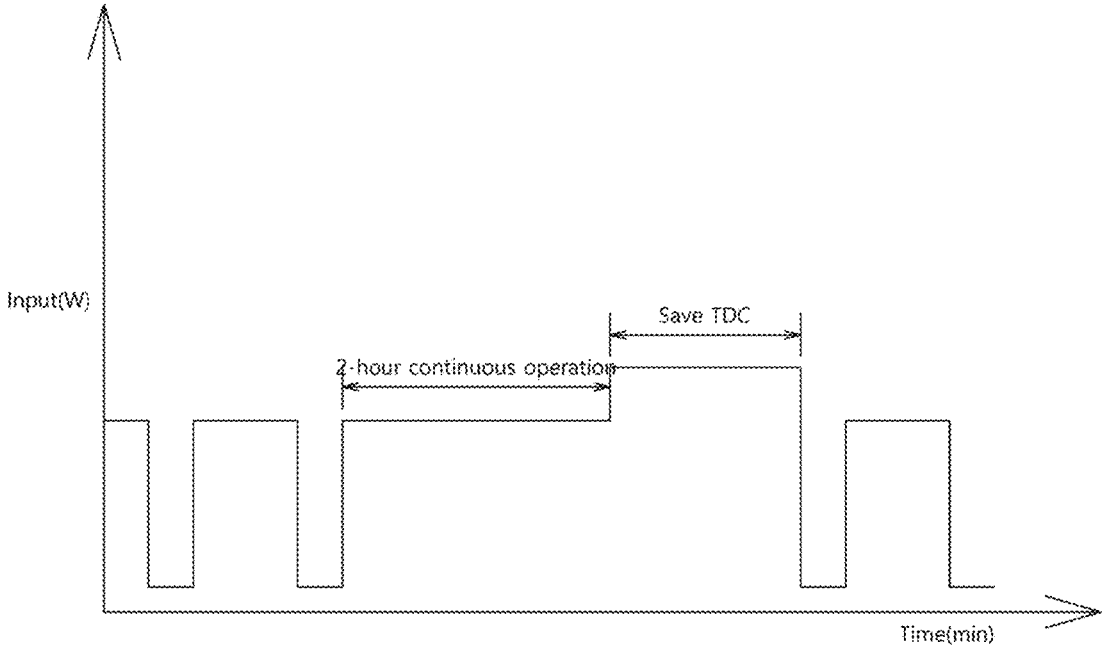

【Figure 14】
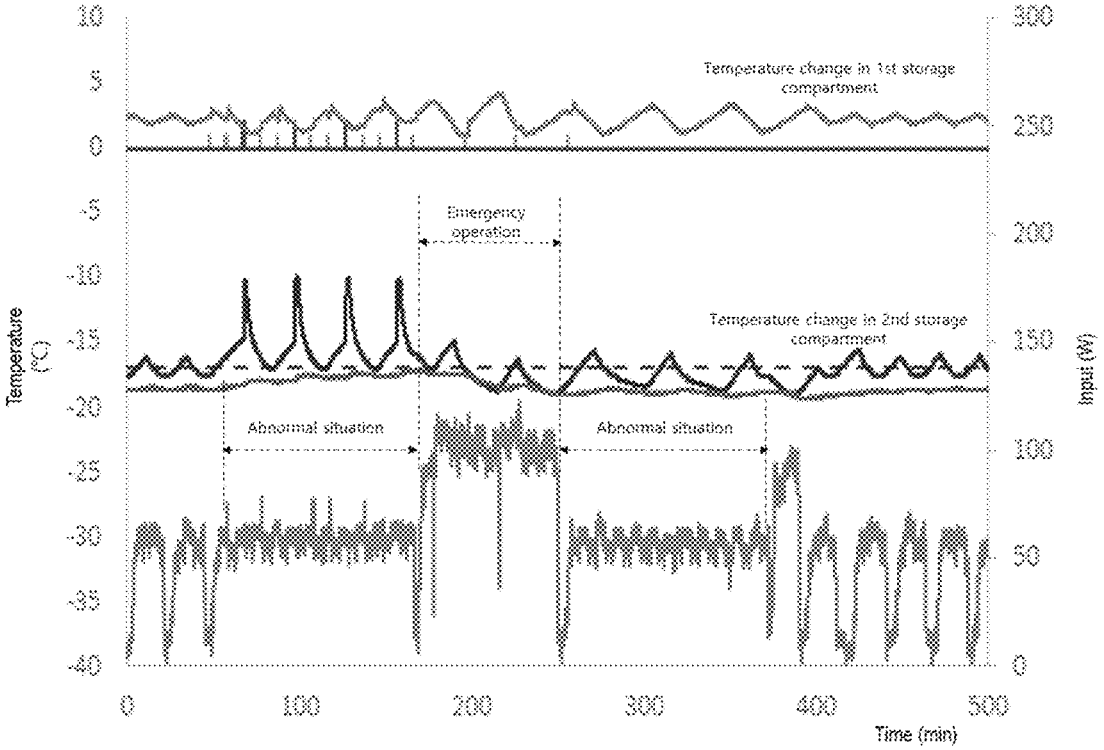

【Figure 15】
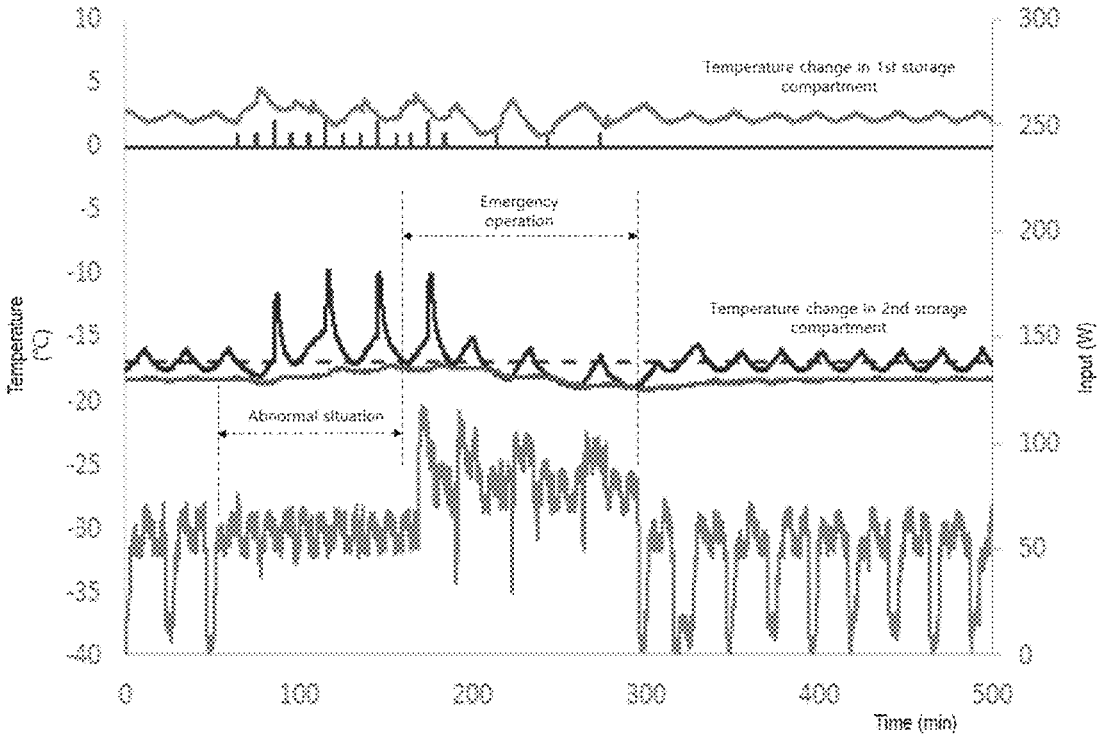

【Figure 16】
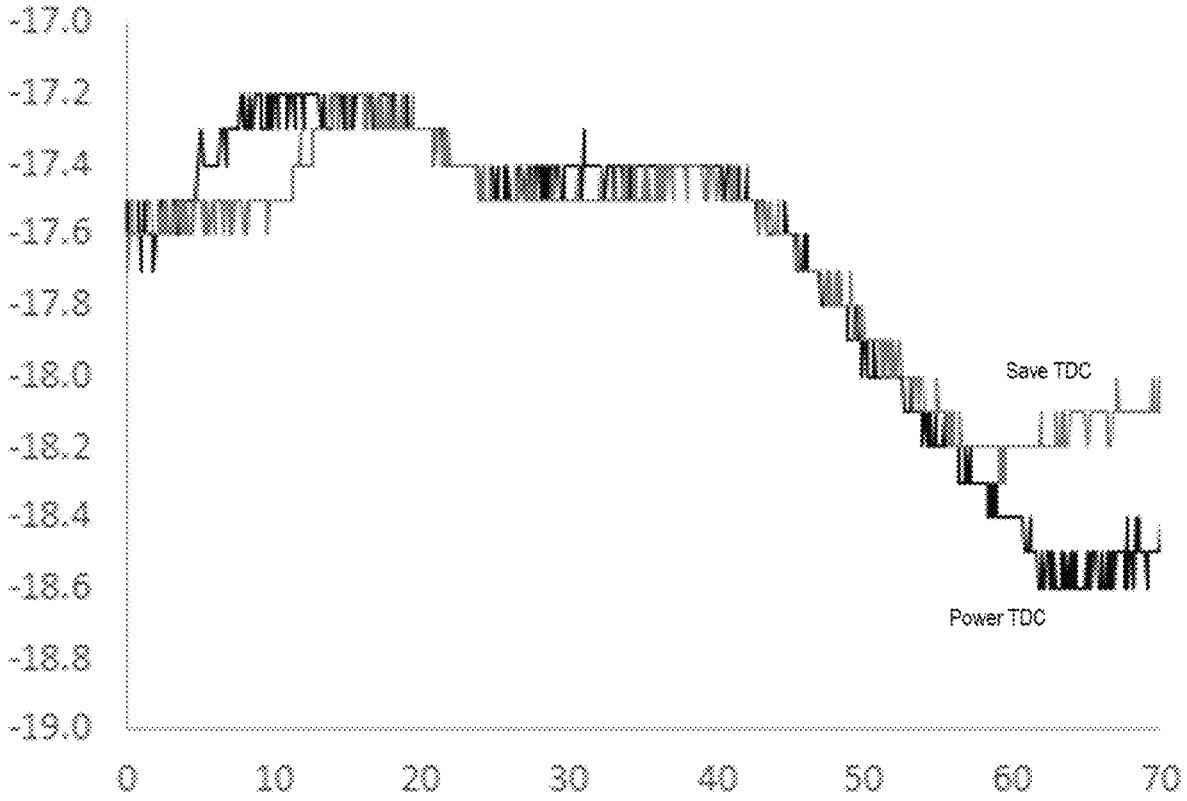

REFRIGERATOR AND CONTROL METHOD THEREOF

CROSS REFERENCE TO RELATED APPLICATION

This application is a National Stage Application of International Application No. PCT/KR2021/016575, filed on Nov. 12, 2021, which claims priority to Korean Patent Application No. 10-2020-0174462, filed on Dec. 14, 2020, the entire contents of which are incorporated herein for all purposes by this reference.

TECHNICAL FIELD

The present disclosure relates to a refrigerator and control method thereof configured to perform an emergency operation when a compressor continuously operates for longer than a set time during a storage operation of two storage compartments in which stored items are stored at different temperature areas.

BACKGROUND ART

In general, a refrigerator is a device that may store objects in a storage space for a long time or while maintaining a constant temperature by using cold air.

The refrigerator includes a refrigeration system including a compressor and an evaporator to generate and circulate cold air.

A temperature control for a storage compartment operates the compressor to supply cold air into the storage compartment when the temperature rises further than an upper limit notch temperature (NT+diff) based on a set notch temperature (NT) of the storage compartment, and when the temperature decreases further than a lower limit notch temperature (NT-diff) based on the set notch temperature (NT), the operation of the compressor is stopped to block the cold air supplied to the storage compartment.

Since the compressor performs a function of adjusting the cooling power of the cold air supplied to the storage compartment, a lot of power is consumed during operation of the compressor.

Accordingly, efforts to reduce the operation time of the compressor have been made to improve power consumption. In this regard, various technologies have been proposed, such as, Patent Publication No. 1995-0025399, Patent Publication No. 10-2004-0061325, Patent Publication No. 10-2019-0096698.

Meanwhile, during a normal storage operation for the storage compartment, there are cases where the temperature of the storage compartment does not reach a satisfaction region quickly due to the frequent opening and closing of the storage compartment door or the high temperature of the stored items in the storage compartment. Accordingly, there are cases where the compressor constituting a refrigeration system continues to operate in order to satisfy the temperature in the storage compartment.

In this way, when the compressor continues to operate, power consumption inevitably increases. So, conventionally, when the compressor is continuously operated for more than a set time (typically 2 hours), an emergency operation is performed to resolve the abnormal situation.

However, since the emergency operation of the prior art is set to be operated with the maximum cooling power that the compressor may perform, each storage compartment may quickly reach a normal temperature area, while overcooling may occur.

For example, if the temperature when the compressor is continuously operated for a set time reaches a satisfactory temperature of the storage compartment, even if the compressor is not operated with maximum cooling power, the temperature of the storage compartment may easily reach the satisfactory area, but power consumption due to the operation of the compressor with maximum cooling power is inevitably caused.

In particular, recently, as in the technology presented in Korean Patent No. 10-2018-0055242, when the door is opened, a load operation is performed based on the temperature change in the storage compartment.

That is, when the temperature in the storage compartment is excessively increased because the door is opened for a long time or the hot food is stored in the storage compartment, the compressor is operated with the maximum cooling power to prevent decomposition or deterioration of other food.

However, when such a load operation is performed, the compressor is frequently operated continuously over a set time, which inevitably results in more serious power consumption.

In addition, in the emergency operation of the prior art described above, when two or more storage compartments are provided, the compressor is operated at the maximum cooling power until the temperature of each of the two storage compartments reaches a satisfaction region, so that the storage compartment operated at a relatively high temperature among the two storage compartments has a problem of overcooling due to excessive supply of cold air, thereby causing complaints, such as undesirably freezing of the stored items.

DISCLOSURE

Technical Problem

The present disclosure is designed to solve various problems according to the prior art described above. The purpose of the present disclosure is to provide a refrigerator and a control method thereof capable of reducing power consumption when an emergency operation is performed by continuously operating a compressor for a set time or more while a storage operation of two storage compartments in which storage items are stored is performed.

Another objective of the present disclosure is to provide a refrigerator and a control method thereof capable of satisfying the compartment temperatures of all storage compartments at the same time by differently setting a cooling power of a compressor in an emergency operation according to the compartment temperature of each storage compartment.

Technical Solution

According to the refrigerator of the present disclosure, cooling power for supplying cold air to a first storage compartment or a second storage compartment may be determined by considering the compartment temperature of the first storage compartment and the second storage compartment together.

According to the refrigerator of the present disclosure, an emergency operation may be performed when the compressor is continuously operated for a set normal operation time or more.

According to the refrigerator of the present disclosure, the emergency operation may be performed when the temperature inside either the first or second storage compartment is within a dissatisfaction region.

According to the refrigerator of the present disclosure, the cooling power may be set to be higher as the temperature area of the second storage compartment is higher than that of the first storage compartment.

According to a control method of the refrigerator of the present disclosure, when an abnormal situation occurs, an emergency operation step of checking the compartment temperatures of the first and second storage compartments may be performed.

According to the control method of the refrigerator of the present disclosure, the emergency operation step may be performed while controlling the operation of the compressor after cooling power is determined by considering the compartment temperature of each storage compartment.

According to the refrigerator control method of the present disclosure, the abnormal situation may include a case where the continuous operation time of the compressor exceeds the set operation time.

According to the refrigerator control method of the present disclosure, the abnormal situation may include a case where the temperature inside either the first or second storage compartment is within the dissatisfaction region.

According to the refrigerator control method of the present disclosure, the temperature of the dissatisfaction region may include a temperature area higher than an upper limit notch temperature (NT+diff).

According to the refrigerator control method of the present disclosure, the temperature of the satisfaction region may be a temperature between the upper limit notch temperature (NT+diff) and a lower limit notch temperature (NT-diff).

According to the refrigerator control method of the present disclosure, the cooling power may be set higher as the compartment temperature of either the first or second storage compartment is in a higher temperature region.

According to the refrigerator control method of the present disclosure, the cooling power may be set even higher as the temperature area of the second storage compartment is higher than that of the first storage compartment.

According to the refrigerator control method of the present disclosure, when the compartment temperatures of both the first second storage compartments are in the dissatisfaction region, the refrigerator may be operated at maximum cooling power.

According to the refrigerator control method of the present disclosure, it may be operated with a lower cooling power when the compartment temperature of the first storage compartment is in the satisfaction region but that of the second storage compartment is in the dissatisfaction region than when the compartment temperature of the first storage compartment is in the dissatisfaction region but that of the second storage compartment is in the satisfaction region.

According to the refrigerator control method of the present disclosure, it may be operated with a lower cooling power when the compartment temperature of the first storage compartment is in the satisfaction region but that of the second storage compartment is in the dissatisfaction region than when the compartment temperatures of both the first and second storage compartments are in the dissatisfaction region.

According to the refrigerator control method of the present disclosure, it may be operated with a lower cooling power when the compartment temperature of the first storage compartment is in the dissatisfaction region but the that of the second storage compartment is in the satisfaction region than when the compartment temperatures of both the first and second storage compartments are in the dissatisfaction region.

According to the refrigerator control method of the present disclosure, it may be operated with maximum cooling power when the compartment temperature of the first storage compartment is higher than the temperature area between the upper limit notch temperature (NT+diff) and the set notch temperature (NT).

According to the refrigerator control method of the present disclosure, it may be operated with maximum cooling power when the compartment temperature of the second storage compartment is in the dissatisfaction region and the compartment temperature of the first storage compartment is higher than the temperature area between the upper limit notch temperature (NT+diff) and the set notch temperature (NT).

According to the refrigerator control method of the present disclosure, it may be operated with the lowest cooling power when the compartment temperature of the first storage compartment is lower than the temperature area between the set notch temperature (NT) and the lower limit notch temperature (NT−diff).

According to the refrigerator control method of the present disclosure, it may be operated with the lowest cooling power when the compartment temperature of the second storage compartment is lower than the lower limit notch temperature (NT−diff) and the compartment temperature of the first storage compartment is lower than the temperature area between the set notch temperature (NT) and the lower limit notch temperature (NT−diff).

According to the refrigerator control method of the present disclosure, the cooling power may vary depending on the temperature area in at least one of the first storage and second storage compartment.

According to the refrigerator control method of the present disclosure, the cooling power may be controlled to be decreased as the temperature area in at least one of the first and second storage compartment is lowered.

According to the refrigerator control method of the present disclosure, the cooling power of a cooling power control means may be controlled to be decreased when the temperature area in the second storage compartment becomes lower than when the temperature area in the first storage compartment is lowered.

According to the refrigerator control method of the present disclosure, during the emergency operation, when the temperature in at least one storage compartment increases and the temperature reaches the upper limit notch temperature (NT+diff), the cooling power of the cooling power control means may be controlled to be increased.

According to the refrigerator control method of the present disclosure, during the emergency operation, when the temperature in at least one storage compartment decreases and the temperature reaches the lower limit notch temperature (NT−diff), the cooling power of the cooling power control means may be controlled to be decreased.

Advantageous Effect

In a refrigerator and a control method thereof according to the present disclosure, when a compressor operates continuously for more than a set time during a normal storage operation of the two storage compartments where the storage is stored, cooling power is determined differently depending on the compartment temperature of each storage compartment, thereby reducing power consumption.

In addition, the refrigerator and the control method thereof according to the present disclosure may further reduce power consumption by controlling cooling power to be varied according to the temperature regions of the two storage compartments even during emergency operation.

Further, the refrigerator and the control method thereof according to the present disclosure may quickly normalize and reduce power consumption since the cooling power controlled during the emergency operation is determined to be greater than the cooling power during the normal storage operation.

DESCRIPTION OF DRAWINGS

FIG. 1 is a state diagram illustrating an internal structure of a refrigerator according to an embodiment of the present disclosure.

FIG. 2 is a block diagram schematically illustrating a structure for a load operation of the refrigerator according to the embodiment of the present disclosure.

FIG. 3 is a state diagram schematically illustrating the structure of a thermoelectric module according to the embodiment of the present disclosure.

FIG. 4 is a block diagram schematically illustrating a refrigeration cycle of the refrigerator according to the embodiment of the present disclosure.

FIG. 5 is a diagram schematically illustrating an operation state performed according to an operation base value based on a user setting notch temperature for a storage compartment of the refrigerator according to the embodiment of the present disclosure.

FIG. 6 is a table for determining cooling power according to a temperature region of each storage compartment of the refrigerator according to the embodiment of the present disclosure.

FIG. 7 is a table illustrating required cooling power for a drop in temperature of each storage compartment of the refrigerator according to the embodiment of the present disclosure.

FIG. 8 is a table for explaining a time required for the temperature drop of each storage compartment temperature region of the refrigerator according to the embodiment of the present disclosure.

FIG. 9 is a flowchart illustrating a control method of the refrigerator according to the embodiment of the present disclosure.

FIG. 10 is a flowchart illustrating a control process during the load operation in the control method of the refrigerator according to the embodiment of the present disclosure.

FIG. 11 is a flowchart illustrating a control process during an emergency operation in the control method of the refrigerator according to the embodiment of the present disclosure.

FIG. 12 is a graph illustrating a load providing state during the emergency operation of a conventional refrigerator.

FIG. 13 is a graph illustrating a load providing state during the emergency operation of the refrigerator according to the embodiment of the present disclosure.

FIG. 14 is a state diagram showing changes in cooling power and temperature changes in each storage compartment when an emergency operation is performed in an abnormal situation in a conventional refrigerator.

FIG. 15 is a state diagram showing changes in cooling power and temperature changes in each storage compartment when an emergency operation is performed in an abnormal situation according to a refrigerator control method according to an embodiment of the present disclosure.

FIG. 16 is a state diagram showing a temperature change in the second storage compartment due to a power saving control (Save TDC) during an emergency operation according to an embodiment of the present disclosure compared to a conventional case of providing maximum cooling power.

BEST MODE

Hereinafter, preferred embodiments of the refrigerator and the control method thereof according to the present disclosure will be described with reference to FIGS. 1 to 16.

FIG. 1 is a state diagram illustrating an internal structure of the refrigerator according to the embodiment of the present disclosure, and FIG. 2 is a block diagram schematically illustrating a structure for a load operation of the refrigerator according to an embodiment of the present disclosure.

As shown in these drawings, the refrigerator according to the embodiment of the present disclosure may determine a cooling power of a cooling control means considering temperatures of a first storage compartment and a second storage compartment when an emergency operation is performed, thereby reducing power consumption and preventing over-cooling.

The refrigerator according to the embodiment of the present disclosure will be described in more detail.

First, the refrigerator according to the embodiment of the present disclosure includes a cabinet 11.

The cabinet 11 includes an inner-cabinet 11*a* forming an interior wall of the refrigerator 1 and an outer cabinet 11*b* forming an exterior, and a storage compartment in which a stored material is stored is provided by the cabinet 11.

Only one storage compartment may be provided or two or more storage compartments may be provided. In an embodiment of the present disclosure, for example, two storage compartments for storing stored materials in different temperature regions are included.

The storage compartment may include a first storage compartment 12 maintained at a first set notch temperature (NT).

The first set notch temperature (NT) may indicate a temperature area where the storage is not frozen, but it may be in a lower than a temperature (room temperature) outside the refrigerator 1.

For example, the first set notch temperature (NT) may be set to a temperature of the storage compartment (CT: Compartment Temperature) of less than or equal to 32° C. and higher than 0° C. Of course, the first set notch temperature (NT) may be set higher than 32° C., or equal to or lower than 0° C., if necessary (e.g., depending on the room temperature outside of the refrigerator or the type of storage).

In particular, the first set notch temperature (NT) may be the temperature of the first storage compartment 12 (CT) set by a user, and if the user does not set the first set notch temperature (NT), a predetermined specified temperature is used as the first set notch temperature (NT).

In addition, the first storage compartment 12 is subjected to a normal storage operation at a first operation base value (NT+diff) to maintain the first set notch temperature (NT).

The first operation base value (NT+diff) is a temperature area value of a satisfaction region including a first lower limit notch temperature (NT−diff) and a first upper limit notch temperature (NT+diff).

That is, when the temperature of the first storage compartment 12 reaches the first lower limit notch temperature (NT−diff) based on the first set notch temperature (NT), the operation for supplying cold air is stopped. On the other hand, when the temperature of the storage compartment rises based on the first set notch temperature (NT), the operation for supplying cold air resumes before reaching the first upper limit notch temperature (NT+diff).

As such, in the first storage compartment 12, cold air is supplied or stopped in consideration of the first operation base value (NT+diff) of the first storage compartment 12 based on the first set notch temperature (NT) and thus the normal storage operation is performed.

The first set notch temperature (NT) and the first operation base value (NT+diff) are as shown in FIG. 3.

In addition, the storage compartment may include a second storage compartment 13 maintained at a second set notch temperature (NT2).

The second set notch temperature (NT2) may be lower than the first set notch temperature (NT). In this case, the second set notch temperature (NT2) may be set by the user, and when the user does not set it, a predetermined specified temperature is used.

The second set notch temperature (NT2) may be a temperature sufficient to freeze the storage. For example, the second set notch temperature (NT2) may be set to a temperature of equal to or lower than 0° C. or equal to or higher than −24° C.

Of course, the second set notch temperature (NT2) may be set higher than 0° C., or equal to or lower than −24° C., as necessary (e.g., depending on the room temperature or type of storage).

In particular, the second set notch temperature (NT2) may be the temperature of the second storage compartment 13 set by the user, and if the user does not set the second set notch temperature (NT2), a predetermined specified temperature may be used as the second set notch temperature (NT2).

In addition, the second storage compartment 13 may be operated at a second operation base value (NT2±diff) to maintain the second set notch temperature (NT2).

The second operation base value (NT2±diff) is a temperature area value of the satisfaction region including a second lower limit notch temperature (NT2−diff) and a second upper limit notch temperature (NT2±diff).

That is, when the temperature of the second storage compartment 13 reaches the second lower limit notch temperature (NT2−diff) based on the second set notch temperature (NT2), the operation for supplying cold air may be stopped. On the other hand, when the temperature of the storage compartment rises based on the second set notch temperature (NT2), the operation for supplying cold air resumes before reaching the second upper limit notch temperature (NT2±diff).

As such, in the second storage compartment 13, cold air is supplied or stopped in consideration of the second operation base value (NT2±diff) for the second storage compartment 13 based on the second set notch temperature (NT2).

In particular, the first operation base value (NTtdiff) may be set to have a smaller area between the upper limit notch temperature (NT+diff) and the lower limit notch temperature (NT−diff) than the second operation base value (NT2±diff).

For example, the first lower limit notch temperature (NT-diff) and the first upper limit notch temperature (NT+diff) of the first operation base value (NTtdiff) may be set to ±2.0° C., and the second lower limit notch temperature (NT2−diff) and the second upper limit notch temperature (NT2±diff) of the second operation base value (NT2±diff) may be set to ±1.5° C.

Meanwhile, each of the above-described storage compartments 12 and 13 is configured such that the temperature of the storage compartment is maintained while a fluid is circulated.

The fluid may be air. In the following description, an example is that the fluid circulating through the storage compartments 12 and 13 is air. Of course, the fluid may be a gas other than air.

The temperature outside the storage compartments 12 and 13 (room temperature) may be measured by a room temperature sensor 1*a*, and the compartment temperature (temperatures inside the first and second storage compartments) may be measured by compartment temperature sensors 1*b* and 1*c* (see FIG. 2 attached).

Each of the temperature sensors 1*a*, 1*b*, and 1*c* may be performed separately. Of course, the room temperature and each compartment temperature (CT) may be measured by a single temperature sensor, or may be configured to be measured by two or more temperature sensors cooperatively.

In addition, doors 12*a* and 13*a* are provided in the storage compartments 12 and 13.

The doors 12*a*, 13*a* serve to open and close the storage compartments 12, 13, and may be configured as a rotary opening/closing structure or a drawer type opening 1 closing structure.

The doors 12*a* and 13*a* may be provided in one or more plurality.

In particular, at least any one of the doors 12*a* and 13*a* or the cabinet 11 may be provided with a detection sensor 14 capable of detecting whether the doors 12*a* and 13*a* are opened.

Next, the refrigerator 1 according to an embodiment of the present disclosure includes a cooling source.

The cooling source is configured to generate cold air.

Such a cooling source may be configured in various ways.

For example, the cooling source may be composed of a thermoelectric module 23.

In this case, the thermoelectric module 23 may include a thermoelectric element 23*a* including a heat absorbing surface 231 and a heat generating surface 232, and a sink 23*b* connected to at least one of the heat absorbing surface 231 and the heat generating surface 232, as shown in FIG. 3.

In addition, the cooling source may be composed of evaporators 21 and 22.

The evaporators 21 and 22 form the refrigeration system with the compressor 60 (see attached FIG. 4), a condenser (not shown), and an expander (not shown), and operate to lower the temperature of the air while exchanging heat with air passing through the evaporator.

When the storage compartment includes the first storage compartment 12 and the second storage compartment 13, the evaporator may consist of a first evaporator 21 for supplying cold air to the first storage compartment 12 and a second evaporator 22 for supplying cold air to the second storage compartment 13.

In this case, the first evaporator 21 may be located at a rear side of the first storage compartment 12 in the inner casing 11*a*, and the second evaporator 22 may be located at a rear side of the second storage compartment 13.

Although not shown, the evaporator may be provided only in at least one of the first storage compartment 12 or the second storage compartment 13.

In addition, even if the two evaporators 21 and 22 are provided, only one compressor 60 constituting the corresponding refrigeration system may be provided.

In this case, as shown in FIG. 4, the compressor 60 may be connected to supply the refrigerant to the first evaporator 21 through a first refrigerant passage 61 and may be connected to supply the refrigerant to the second evaporator 22 through a second refrigerant passage 62. In this case, each of the refrigerant passages 61 and 62 may be selectively opened and closed using a refrigerant valve 63.

Next, the refrigerator 1 according to the embodiment of the present disclosure includes a cooling power control means.

The cooling power control means is provided to control a cooling power of the cold air supplied to the first storage compartment 12.

The cooling power control means may be configured to control a load by a controller 70, and the cooling power control means may include at least one of a compressor 60 and a first cooling fan 31.

Here, the compressor 60 is one of the components that forms a refrigeration system with the cooling sources (evaporators) 21 and 22, and the cooling power may be controlled by adjusting the load of the compressor 60.

In addition, the first cooling fan 31 is a device for supplying cold air generated while passing through the first evaporator 21 to the first storage compartment 12. Cooling power may be controlled by adjusting the load (rotation speed control) of the first cooling fan 31.

Of course, the refrigerator may further include a second cooling fan 41 supplying cold air generated while passing through the second evaporator 22 to the second storage compartment 13, or the first cooling fan 31 (or the second cooling fan) may be configured to supply cold air generated while passing through the first evaporator 21 or the second evaporator 22 to the second storage compartment 13.

Next, the refrigerator 1 according to the embodiment of the present disclosure includes a controller 70. The controller may be a microprocessor, an electrical logical circuit, and the like.

The controller 70 may be configured to control a load and operation of the cooling power control means. That is, the controller 70 controls the load and operation of the compressor 60 and the first cooling fan 41 constituting the cooling power control means based on a temperature measured by the room temperature sensor 1*a* and the internal refrigerator temperature sensors 1*b* and 1*c*, and each storage compartment 12 and 13 is controlled to maintain each set notch temperature (NT, NT2).

Based on the first set notch temperature (NT), the temperature area between the first upper limit notch temperature (NT+diff) and the first lower limit notch temperature (NT−diff) may be set as a satisfaction region, and a temperature higher than the first upper limit notch temperature (NT+diff) may be set as a dissatisfaction region.

In addition, based on the second set notch temperature (NT2), the temperature area between the second upper limit notch temperature (NT2±diff) and the second lower limit notch temperature (NT2−diff) may be set as the satisfaction region, and a temperature higher than the second upper limit notch temperature (NT2±diff) may be set as the dissatisfaction region. In this regard, it is as shown in FIG. 5 attached.

In addition, the controller 70 may be configured to control the supply of cold air alternately to the two storage compartments 12 and 13.

In this case, the controller 70 considers the temperature of the first storage compartment 12 first when operating.

That is, when the temperature (CT: Compartment Temperature) of the first storage compartment 12 is in the dissatisfaction region, cold air is supplied to the first storage compartment 12 regardless of the temperature (CT2) of the second storage compartment 13. When the temperature (CT) of the first storage compartment 12 is in the satisfaction region, cold air is controlled to be supplied to the second storage compartment 13.

Of course, when a part of the flow path supplying cold air to the two storage compartments 12 and 13 is formed to be shared with each other, some portion of cold air may be supplied to the second storage compartment 13 while cold air is supplied to the first storage compartment 12, or alternatively, while cold air is being supplied to the second storage compartment 13, some of the cold air may also be supplied to the first storage compartment 12.

In addition, the controller 70 may be configured to perform the normal storage operation for the first storage compartment 12 or the second storage compartment 13.

In the normal storage operation, when the temperature (CT, CT2) in each storage compartment 12 and 13 reaches the lower limit notch temperature (NT−diff, NT2−diff) based on the set notch temperature (NT, NT2), the supply of cold air is stopped. And the temperature (CT, CT2) rises based on the set notch temperature (NT, NT2), the operation for supplying cold air is resumed before (or when reaching) the upper limit notch temperatures (NT+diff, NT2±diff).

In this normal storage operation, cold air is alternately supplied to each of the storage compartments 12 and 13, and the temperature of each compartment (CT, CT2) maintains between the upper limit notch temperature (NT+diff, NT2±diff) and the lower limit notch temperature (NT−diff, NT2−diff).

In addition, the controller 70 may be configured to perform the load operation for the first storage compartment 12 or the second storage compartment 13.

The load operation is an operation that prevents an excessive temperature rise after the doors 12*a* and 13*a* are opened while the refrigerator is operating in the normal storage operation.

In addition, the controller 70 may be configured to perform the emergency operation when an abnormal situation occurs.

The abnormal situation may include a case where the compressor 60 continuously operates for a set normal operation time or more, and the compartment temperature (CT, CT2) of at least one of the first storage compartment 12 and the second storage compartment 13 is in the dissatisfaction region. When such an abnormal situation occurs, the controller 70 performs the emergency operation.

For example, when the compressor 60 is operated continuously for more than two hours and the compartment temperature (CT, CT2) of at least one storage compartment 12, 13 is in the dissatisfaction region, it is determined that the condition for emergency operation is satisfied and emergency operation is performed.

In such an emergency operation, the cooling power of the cooling power control means is controlled to alternately supply the cold air to the two storage compartments 12, 13.

In particular, the controller 70 determines the cooling power of the cooling power control means for supplying cold air to the first storage compartment 12 or the second storage compartment 13 in consideration of the compartment temperature (CT, CT2) of the first storage compartment 12 and the second storage compartment 13 in the emergency operation, and performs the operation for each storage compartment with the determined cooling power.

That is, when both the compartment temperatures (CT, CT2) of the first and the second storage compartments 12, 13 are in the dissatisfaction region, the operation is controlled at the maximum cooling power. However, when only one of the storage compartments 12 and 13 has an compartment temperature (CT, CT2) in the dissatisfaction region, the control is performed so that the cooling power is higher than the cooling power during the normal storage operation but lower than the maximum cooling power, thereby reducing power consumption.

In addition, when the compartment temperature (CT) of the first storage compartment 12 is in the satisfaction region and the compartment temperature (CT2) of the second storage compartment 13 is in the dissatisfaction region, the cooling power control means may be controlled to operate at a lower cooling power than when the compartment temperatures (CT, CT2) of both the first and second storage compartments 12, 13 are in the dissatisfaction region.

That is, when both the compartment temperatures (CT, CT2) of the first and second storage compartment 12, 13 are in the dissatisfaction region, the operation is performed at the maximum cooling power, and when only one of the storage compartments is in the dissatisfaction region, the operation is performed with the cooling power lower than the maximum cooling power, thereby reducing power consumption.

In addition, the cooling power may be set higher in a temperature region where the compartment temperature CT2 of the second storage compartment 13 is higher than the compartment temperature CT of the first storage compartment 12.

That is, when the compartment temperature (CT) of the first storage compartment 12 is in the satisfaction region and the compartment temperature (CT2) of the second storage compartment 13 is in the dissatisfaction region, the cooling power control means is controlled to operate with a lower cooling power than when the compartment temperature (CT) of the first storage compartment 12 is in the dissatisfaction region and the compartment temperature (CT2) of the second storage compartment 13 is in the satisfaction region In relation to this, it is as shown through the table of FIG. 6 attached.

In this case, region A described in the table of FIG. 6 is a temperature region where the compartment temperature (CT) of the first storage compartment 12 is higher than the first upper limit notch temperature (NT+diff), region B is a temperature region where the first storage compartment 12 is a temperature region between the first upper limit notch temperature (NT+diff) and the first set notch temperature (NT), region C is a temperature region where the first storage compartment 12 is a temperature region between the first lower limit notch temperature (NT−diff) and the first set notch temperature (NT), and the region D is a temperature region where the compartment temperature (CT) of the first storage compartment 12 is lower than the first lower limit notch temperature (NT−diff). This is as shown in the attached FIG. 5

In addition, region A' described in the table of FIG. 6 is a temperature region where the compartment temperature (CT2) of the second storage compartment 13 is higher than the second upper limit notch temperature (NT2±diff), region B' is a temperature region where the second storage compartment 13 is a temperature region between the second upper limit notch temperature (NT2±diff) and the second set notch temperature (NT2), region C' is a temperature region where the second storage compartment 13 is a temperature region between the second lower limit notch temperature (NT2−diff) and the second set notch temperature (NT2), and the region D' is a temperature region where the compartment temperature (CT2) of the second storage compartment 13 is lower than the second lower limit notch temperature (NT2−diff). This is as shown in the attached FIG. 5

In particular, when the compartment temperature (CT2) of the second storage compartment 13 is in the dissatisfaction region, and when the compartment temperature (CT) of the first storage compartment 12 is higher than the temperature region between the upper limit notch temperature (NT+diff) and the set notch temperature (NT), the cooling power control means may be controlled to operate at maximum cooling power.

When the compartment temperature (CT2) of the second storage compartment 13 is lower than the lower limit notch temperature (NT2−diff), and when the compartment temperature (CT) of the first storage compartment 12 is lower than the temperature region between the lower limit notch temperature (NT−diff) and the set notch temperature (NT), the cooling power control means may be controlled to operate at the lowest cooling power.

The method of determining the cooling power as described above is because the cooling power required to move the compartment temperature of the second storage compartment 13 from the dissatisfaction region to the satisfaction region is greater and the required time is longer than the cooling power required to move the compartment temperature of the first storage compartment 12 from the dissatisfaction region to the satisfaction region. In this regard, as shown in the tables of FIGS. 7 and 8 attached.

Along with this, the controller 70 may control the cooling power of the cooling power control means to vary depending on a temperature area in at least one of the first storage compartment 12 or the second storage compartment 13 during the emergency operation.

For example, as the temperature area in at least one of the first storage compartment 12 and the second storage compartment 13 decreases, the cooling power control means may be controlled with a lower cooling power.

In particular, as the temperature area in the second storage compartment 13 becomes lower than when the temperature area in the first storage compartment 12 is lowered, the cooling power control means may be controlled with a lower cooling power.

Meanwhile, according to the above-described normal storage operation, load operation, or emergency operation, the controller 70 may differently control the load of the cooling power control means (compressor or first cooling fan).

For example, during the normal storage operation, the temperature of each storage compartment 12, 13 may be controlled to gradually decrease while operating as a power-saving operation considering the power consumption of the cooling power control means (compressor or first cooling fan).

Meanwhile, in order to prevent deterioration of food, during the load operation or the emergency operation, the temperature of each storage compartment 12, 13 may be controlled to be rapidly lowered while controlling the cooling power control means (compressor or first cooling fan) to operate at a higher load than in the normal storage operation.

In addition, when the first door 12*a* is re-opened while the load operation is being performed, the controller 70 may control the load operation to be performed while operating the cooling power control means (compressor or the first cooling fan) at the maximum load. That is, when the first door 12*a* is re-opened during the load operation, the maximum cooling power may be provided when the first door 12*a* is closed regardless of whether the operation start condition is satisfied.

At this time, the maximum load is a load sufficient to provide a higher cooling power than the cooling power during the normal storage operation.

Of course, the supply of the maximum cooling power described above is performed until a predetermined time elapses after the load operation is re-performed, and thereafter, it is more preferable to control the cooling power to be varied according to the temperature in the first storage compartment 12.

In addition, the controller 70 controls the load operation to be stopped and a pre-defrosting operation for a defrosting operation to be preferentially performed when an input condition of the defrosting operation is satisfied while the load operation is being performed.

In particular, the pre-defrosting operation may control the cooling power control means (compressor and first cooling fan) to be operated at the maximum load until the compartment temperature CT of the first storage compartment 12 reaches a defrost temperature lower than the first lower limit notch temperature (NT−diff).

The control of the controller 70 is to minimize the time until the defrost temperature is reached even when the compartment temperature is in the temperature area of the first upper limit notch temperature (NT+diff) or higher.

In addition, the controller 70 performs the defrosting operation after the pre-defrosting operation is completed. After the defrosting operation is completed, the controller 70 may control the cooling power control means at the maximum load until the compartment temperature (CT) of the first compartment 12 reaches a temperature lower than the first set notch temperature (NT).

Next, a control method for the normal storage operation and the emergency operation of the refrigerator according to an embodiment of the present disclosure will be described in more detail with reference to the accompanying flowcharts of FIGS. 9 to 11.

Prior to the description, each operation is performed under the control of the controller 70 which receives a sensing value of each temperature sensor (1*a*, 1*b*, 1*c*) and operates the refrigeration system.

First, as shown in the flowchart of FIG. 9, the controller 70 continuously acquires a sensing value at S110 for the compartment temperatures (CT, CT2) of each storage compartment 12, 13.

The compartment temperatures (CT, CT2) of the storage compartments are measured by each temperature sensor 1*b* and 1*c* located in each storage compartment 12 and 13, and the measured temperature is provided to the controller 70.

In addition, the controller 70 continuously performs the normal storage operation for the first storage compartment 12, while controlling the cooling power control means based on the acquired the compartment temperatures (CT, CT2) at S120.

The above normal storage operation is performed to maintain the temperature area of the satisfaction region (temperature area between the upper limit notch temperature (NT+diff, NT2±diff) and the lower limit notch temperature (NT−diff, NT2−diff) based on the set notch temperature (NT, NT2) for each storage compartment.

In this case, the compressor 60 constituting the refrigeration system during the normal storage operation is controlled to operate at a lower output than the load operation or the emergency operation.

In addition, in the normal storage operation, when the upper limit notch temperature (NT+diff, NT2±diff) is reached, the compressor 60 is operated to increase the supply of cold air. Before the lower limit notch temperature (NT−diff, NT2−diff) is reached, the operation of the compressor 60 is stopped to reduce the supply of cold air, and this operation is continuously repeated.

Of course, the compressor 60 may be controlled to operate before reaching the upper limit notch temperature (NT+diff, NT2±diff), or may be controlled to operate when reaching the dissatisfaction region exceeding the upper limit notch temperature (NT+diff, NT2±diff).

In particular, in the normal storage operation, the first storage compartment 12 is operated with priority. That is, when both the compartment temperatures of the first storage compartment 12 and the second storage compartment 13 are in the dissatisfaction region, the compartment temperature (CT) of the first storage compartment (12) is preferentially operated to reach the satisfaction region, and then the compartment temperature (CT2) of the second storage compartment 13 is operated to reach the satisfaction region.

This is because in the first storage compartment 12, there is a concern that the stored items may deteriorate even if a small temperature change occurs, whereas in the case of the second storage compartment 13, the occurrence of a temperature change does not significantly affect the stored items.

Of course, when the first storage compartment 12 falls into the dissatisfaction region or reaches the upper limit notch temperature (NT+diff) even while cold air is being supplied to the second storage compartment 13, the operation for the second storage compartment 13 is switched to the operation for the first storage compartment 12.

In addition, while the normal storage operation is being performed, the controller 70 continuously checks whether the start condition of the load operation or the start condition of the emergency operation is satisfied at S130, S140.

When the start condition of the load operation is satisfied while the normal storage operation is performed, the load operation (S2) is performed.

The load operation (S2) is performed while being operated at a higher cooling power than the normal storage operation at S210. When the termination condition of the load operation (S2) is satisfied by confirming the condition at S220, the load operation is terminated at S230.

When the start condition of the emergency operation is satisfied while the normal storage operation is being performed, the emergency operation (S3) is performed. Of course, even while the load operation (S2) is being performed, the emergency operation (S3) may be performed when the start condition of the emergency operation (S3) is satisfied.

The start condition for the emergency operation (S3) may be an occurrence of abnormal situation.

The abnormal situation may include a case where the compressor 60 continuously operates for a set normal operation time or more, and the compartment temperature (CT, CT2) of at least one of the first storage compartment 12 and the second storage compartment 13 is in the dissatisfaction region.

That is, when one of the storage compartments 12 and 13 is still in the dissatisfaction region even though the compressor 60 is continuously operated for a set time, it is determined as an abnormal situation. At this time, the temperature of the dissatisfaction region is defined as the area (A, A') with a temperature higher than the upper limit notch temperature (NT+diff, NT2±diff).

When the abnormal situation occurs, the controller 70 checks the compartment temperature (CT, CT2) of the first and the second storage compartments 12 and 13 sensed by the temperature sensors 1*b* and 1*c*.

Also, the controller 70 determines the cooling power of the cooling power control means for emergency operation by considering the compartment temperature (CT, CT2) of each of the storage compartments 12 and 13.

The cooling power is determined by simultaneously considering the compartment temperature (CT, CT2) of both storage compartments 12, 13 rather than determining the cooling power only by the compartment temperature of one storage compartment. This is because the cooling power or time required to reach each satisfaction region is different depending on the compartment temperature (CT, CT2) of the first storage compartment 12 and the second storage compartment 13.

The cooling power may be determined differently according to various situations.

For example, the cooling power may be determined to be set high in the higher temperature area of the first storage compartment 12 or the second storage compartment 13, or the cooling power of the cooling power control means may be determined to be set higher in a temperature area where the compartment temperature (CT2) of the second storage compartment 13 is higher than the compartment temperature (CT) of the first storage compartment 12.

That is, when the compartment temperature (CT, CT2) of each storage compartment 12, 13 is the temperature region (C, C') between the lower notch temperature (NT−diff, NT2−diff) and the set notch temperature (NT, NT2) than in the temperature region (D, D') lower than the lower limit notch temperature (NT−diff, NT2−diff), it may be determined to provide higher cooling power.

In addition, it may be determined to provide higher cooling power when the compartment temperature (CT, CT2) of each storage compartment 12, 13 is in the temperature region (B, B') between the set notch temperature (NT, NT2) and the upper limit notch temperature (NT+diff, NT2±diff) than the temperature region (C, C') between the lower limit notch temperature (NT−diff, NT2−diff) and the set notch temperature (NT, NT2).

At the same time, it may be determined to provide higher cooling power when the compartment temperature (CT, CT2) of each storage compartment 12, 13 is in the temperature region (A, A) that exceeds the upper limit notch temperature (NT+diff, NT2±diff) than the temperature region (B, B) between the upper notch temperature (NT+diff, NT2±diff) and the set notch temperature (NT, NT2).

In addition, the cooling power may be determined to provide different cooling power depending on the compartment temperature (CT, CT2) of the first storage compartment 12 and the second storage compartment 13.

For example, as shown in the attached table of FIG. 6, when the compartment temperature (CT) of the first storage compartment 12 is in the region B, it is determined to provide 90% of the maximum cooling power. When the compartment temperature (CT2) of the second storage compartment 13 is in the region B', 80% of the maximum cooling power may be provided. When the compartment temperature (CT) of the first storage compartment 12 is in the region C, 80% of the maximum cooling power may be provided. When the compartment temperature (CT2) of the second storage compartment 13 is in the region C', it may be determined to provide 60% of the maximum cooling power. When the compartment temperature (CT) of the first storage compartment 12 is in the region D, 70% of the maximum cooling power may be provided. When the compartment temperature (CT2) of the second storage compartment 13 is the region D', it is determined to provide 40% of the maximum cooling power.

Then, the controller 70 performs the emergency operation while controlling the cooling power control means by the cooling power determined by the above-described situational standard.

The emergency operation may be terminated when the compartment temperatures of the two storage compartments 12, 13 are both within the satisfaction region (equal to or less than NT+diff, NT2±diff) (satisfying the operation termination condition).

Preferably, the emergency operation may be terminated when both storage compartments 12 and 13 are lower than the lower limit notch temperatures (regions D and D').

While the emergency operation is being performed, the cooling power may be controlled to vary according to the temperature region in each of the storage compartments 12 and 13.

The cooling power variable for each temperature region of each of the storage compartments 12 and 13 may be determined in the same manner as the method for determining the cooling power during the initial emergency operation.

In particular, when the compartment temperature (CT2) of the second storage compartment 13 is in the temperature region A' (the temperature of the dissatisfaction region) during the emergency operation (or when the emergency operation starts), and when the compartment temperature CT of the first storage compartment 12 is equal to or higher than the region B, the cooling power control means is controlled to operate at the maximum cooling power. In this case, the maximum cooling power may be the maximum cooling power of the compressor 60 determined when both storage compartment 12, 13 are in the temperature region A, A' (dissatisfaction region), or may be at least 90% of the maximum cooling power of the compressor 60.

If the compartment temperature (CT, CT2) of the storage compartments 12, 13 is increased due to the opening of any one of the doors 12*a*, 13*a* during the emergency operation, the cooling power of the cooling power control means is further increased when the compartment temperature (CT, CT2) reaches the upper limit notch temperature (NT+diff, NT2±diff).

Of course, when the rise of the compartment temperature (CT, CT2) is rapidly large, the load operation (providing maximum cooling power at maximum load) may be performed even if the compartment temperature (CT, CT2) does not reach the upper limit notch temperature (NT+diff, NT2±diff). In addition, even when the defrosting operation is performed, the operation of providing the maximum cooling power at the maximum load may be performed.

If the temperature in the storage compartments 12 and 13 reaches the lower limit notch temperature (NT−diff, NT2−diff) due to a continuous temperature drop during the emergency operation, the cooling power of the cooling power control means is further reduced.

In addition, when the compartment temperature CT2 of the second storage compartment 13 is equal to or lower than region D' while the emergency operation is performed, and when the compartment temperature CT of the first storage compartment 12 is equal to or lower than region C, the cooling power control means is controlled to operate at the lowest cooling power. In this case, the minimum cooling power may be 20% or less of the maximum cooling power of the compressor 60.

In addition, when the compartment temperature (CT) of the first storage compartment 12 is equal to or less than region D and the compartment temperature (CT2) of the second storage compartment 13 is equal to or less than region D' during the emergency operation, the controller 70 determines that the termination condition of the emergency operation is satisfied and controls the emergency operation to be terminated.

When the emergency operation is terminated, the controller 70 performs the normal storage operation while controlling the cooling power control means (compressor and each cooling fan) based on the compartment temperature (CT, CT2) in each storage compartment (12, 13).

FIG. 14 shows a change in cooling power and a change in temperature for each storage compartment when the emergency operation is performed when an abnormal situation occurs in a conventional refrigerator. FIG. 15 shows a change in cooling power and a change in temperature for each storage compartment when the emergency operation is performed due to an occurrence of abnormal situation according to the refrigerator control method according to the embodiment of the present disclosure.

As shown in the drawings, power consumption may be reduced and temperature changes in each storage compartment may be reduced by the control method of the refrigerator according to the embodiment of the present disclosure.

In addition, as shown in the graph of FIG. 16, it may be seen that power consumption may be reduced by preventing excessive cold air supply due to power saving control (Save TDC) during the emergency operation according to the embodiment of the present disclosure.

As described above, the refrigerator and the control method thereof according to the present disclosure may reduce power consumption due to the emergency operation by differently determining cooling power according to the compartment temperature (CT, CT2) of each storage compartment 12, 13 when the compressor 60 operates continuously for more than a set time during the normal storage operation of the two storage compartments in which the storage items are stored.

That is, in the conventional refrigerator, as shown in the graph of FIG. 12, high power consumption is caused by operating at the maximum cooling power (Power TDC) during emergency operation. On the other hand, in the case of the present disclosure, power consumption may be reduced as the power saving cooling power (Save TDC) is operated during the emergency operation as shown in the graph of FIG. 13.

In addition, the refrigerator and the control method thereof of the present disclosure may further reduce power consumption by controlling the cooling power to be varied according to the temperature regions of the two storage compartments (12, 13) even during emergency operation.

In addition, the refrigerator and the control method thereof according to the present disclosure may quickly normalize the refrigerator since the cooling power controlled during the emergency operation is determined to be larger than the cooling power during the normal storage operation, thereby reducing power consumption.

What is claimed is:

1. A control method of a refrigerator, the method comprising:

a normal storage operation step of maintaining compartment temperatures of a first storage compartment and a second storage compartment within a satisfaction region while supplying cold air into the first storage compartment and the second storage compartment while performing the normal storage operation;

a load operation step of performing a load operation in response to a start condition of the load operation being satisfied in response to a door being opened while the normal storage operation is being performed;

an emergency operation confirmation step of confirming occurrence of an abnormal situation while at least the normal storage operation or the load operation is being performed; and an emergency operation step of performing an emergency operation according to the occurrence of the abnormal situation wherein the emergency operation step includes:

a temperature checking step of checking the compartment temperatures of the first storage compartment and the second storage compartment in response to the abnormal situation occurring;

a cooling power determination step of determining a cooling power for performing the emergency operation by considering the checked compartment temperatures of the first storage compartment and the second storage compartment; and an operation step of performing the emergency operation while controlling a compressor to operate with the determined cooling power.

2. The method of claim 1, wherein the abnormal situation includes a case where a continuous operation time of a compressor exceeds a set operation time, and a case where the compartment temperature of at least one of the first storage compartment and the second storage compartment is a temperature in a dissatisfaction region.

3. The method of claim 2, wherein the temperature in the dissatisfaction region is a temperature higher than an upper limit notch temperature (NT+diff).

4. The method of claim 1, wherein in the cooling power determination step, the compressor is controlled to operate with a higher cooling power as the higher one of the compartment temperature of the first storage compartment and the compartment temperature of the second storage compartment falls within a higher temperature region.

5. The method of claim 1, wherein in the cooling power determination step, the compressor is controlled to operate with a higher cooling power when the compartment temperature of the second storage compartment is higher than the compartment temperature of the first storage compartment.

6. The method of claim 1, wherein in the cooling power determination step, the compressor is controlled to operate with a maximum cooling power when the compartment temperatures of the first storage compartment and the second storage compartment are in a dissatisfaction region.

7. The method of claim 1, wherein in the cooling power determination step, the compressor is controlled to operate with a higher cooling power in response to the compartment temperature of the first storage compartment being in the satisfaction region and the compartment temperature of the second storage compartment being in a dissatisfaction region than in response to the compartment temperature of the first storage compartment being in the dissatisfaction region and the compartment temperature of the second storage compartment being in the satisfaction region.

8. The method of claim 7, wherein a temperature in the satisfaction region is a temperature between an upper limit notch temperature (NT+diff) and a lower limit notch temperature (NT−diff), and a temperature in the dissatisfaction region is a temperature region higher than the upper limit notch temperature (NT+diff).

9. The method of claim 1, wherein in the cooling power determination step, the compressor is controlled to operate with a lower cooling power in response to the compartment temperature of the first storage compartment being in the satisfaction region and the compartment temperature of the second storage compartment being in a dissatisfaction region than in response to the compartment temperatures of the first storage compartment and the second storage compartment being in the dissatisfaction region.

10. The method of claim 1, wherein in the cooling power determination step, the compressor is controlled to operated with a lower cooling power in response to the compartment temperature of the first storage compartment being in a dissatisfaction region and the compartment temperature of the second storage compartment being in the satisfaction region than in response to the compartment temperatures of the first storage compartment and the second storage compartment being in the dissatisfaction region.

11. The method of claim 1, wherein during the emergency operation, the cooling power of the compressor is controlled to be varied according to a temperature region in at least one of the first storage compartment and the second storage compartment.

12. The method of claim 11, wherein as the temperature region in at least one of the first and second storage compartments decreases in temperature, the compressor is controlled to operate with a lower cooling power corresponding to the decrease in temperature of the temperature region.

13. The method of claim 11, wherein in the cooling power determination step, in response to the compartment temperature of the second storage compartment being in a dissatisfaction region and the compartment temperature of the first storage compartment being higher than a temperature region between an upper limit notch temperature (NT+diff) and a set notch temperature (NT), the compressor is controlled to operate with a maximum cooling power.

14. The method of claim 11, wherein in the cooling power determination step, in response to the compartment temperature of the second storage compartment being lower than a lower limit notch temperature (NT2−diff) and the compartment temperature of the first storage compartment being lower than a temperature between a set notch temperature (NT) and a lower limit notch temperature (NT−diff), the compressor is controlled to operate with a lowest cooling power.

15. The method of claim 1, wherein during the emergency operation, when the compartment temperature of at least one of the first storage compartment and the second storage compartment increases and the increased compartment temperature of the corresponding storage compartment reaches an upper limit notch temperature (NT+diff), the compressor is controlled to operate with a higher cooling power.

16. The method of claim 1, wherein during the emergency operation, in response to the compartment temperature of at least one of the first storage compartment and the second storage compartment decreasing and reaching a lower limit notch temperature (NT-diff), the compressor is controlled to operate with a lower cooling power.

17. The method of claim 1, wherein the compressor is controlled to operate with a higher cooling power during the load operation or emergency operation than during the normal storage operation.

* * * * *